US007088947B1

(12) United States Patent
Dobbertin et al.

(10) Patent No.: US 7,088,947 B1
(45) Date of Patent: Aug. 8, 2006

(54) POST PROCESSOR INSERTER SPEED AND TIMING ADJUST UNIT

(75) Inventors: Michael T. Dobbertin, Honeoye, NY (US); Thomas K. Sciurba, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/668,751

(22) Filed: Sep. 23, 2003

Related U.S. Application Data

(60) Provisional application No. 60/415,036, filed on Sep. 30, 2002.

(51) Int. Cl.
*G03G 15/00* (2006.01)

(52) U.S. Cl. ..... 399/382; 399/407

(58) Field of Classification Search ..... 399/382, 399/407, 396, 383, 394, 397; 271/202, 270
See application file for complete search history.

(56) References Cited

U.S. PATENT DOCUMENTS

| | | | | |
|---|---|---|---|---|
| 4,362,378 A | | 12/1982 | Erskine et al. | 399/139 |
| 4,416,534 A | | 11/1983 | Kluger | 399/396 |
| 4,589,765 A | | 5/1986 | Perun et al. | 399/21 |
| 4,826,148 A | | 5/1989 | Coons, Jr. | 271/245 |
| 4,971,304 A | | 11/1990 | Lofthus | 271/227 |
| 5,057,874 A | | 10/1991 | Miyazaki et al. | 399/396 |
| 5,112,038 A | | 5/1992 | Dunaway | 271/10.03 |
| 5,184,185 A | * | 2/1993 | Rasmussen et al. | 399/130 |
| 5,260,757 A | | 11/1993 | Frank et al. | 399/396 |
| 5,272,511 A | * | 12/1993 | Conrad et al. | 399/382 |
| 5,273,274 A | | 12/1993 | Thomson et al. | 271/228 |
| 5,322,273 A | | 6/1994 | Rapkin et al. | 271/227 |
| 5,337,135 A | * | 8/1994 | Malachowski et al. | 399/401 |
| 5,362,041 A | | 11/1994 | Ryuzaki et al. | 271/236 |
| 5,598,257 A | * | 1/1997 | Keller et al. | 399/364 |
| 5,678,159 A | | 10/1997 | Williams et al. | 399/395 |
| 5,689,795 A | | 11/1997 | Mastrandrea | 399/407 |
| 5,697,608 A | | 12/1997 | Castelli et al. | 271/228 |
| 5,697,609 A | | 12/1997 | Williams et al. | 271/228 |
| 5,715,514 A | | 2/1998 | Williams et al. | 399/395 |
| 5,725,211 A | | 3/1998 | Blanchard et al. | 271/265.02 |

(Continued)

FOREIGN PATENT DOCUMENTS

EP 0 994 397 A2 4/2000

(Continued)

OTHER PUBLICATIONS

Description of Operation for the Kodak 1575 Copier and Finisher, Jun. 14, 2004.

(Continued)

*Primary Examiner*—Anthony H. Nguyen
(74) *Attorney, Agent, or Firm*—Donna P. Suchy

(57) ABSTRACT

In the present invention an image-forming production system includes a marking engine. The marking engine outputs a plurality of printed sheets at a first speed. An inserter is connected to receive the plurality of printed sheets from the marking engine and insert an insert sheet fed at a second speed. The inserter control board transmits synch pulse signals to an inserter speed adjust unit controller when a plurality of sheets approach the inserter speed adjust unit. The inserter speed adjust unit transmits a signal to the inserter speed adjust unit controller indicating an arrival of each of the plurality of sheets. The inserter speed adjust unit controller compares the measured arrival time with the synch pulse signal to adjust a speed of the plurality of sheets and the insert sheet to a third output speed.

17 Claims, 6 Drawing Sheets

U.S. PATENT DOCUMENTS

| | | | | | |
|---|---|---|---|---|---|
| 5,732,943 | A | | 3/1998 | Delfosse | 271/228 |
| 5,826,157 | A | * | 10/1998 | Wierszewski | 399/396 |
| 5,887,996 | A | | 3/1999 | Castelli et al. | 400/579 |
| 5,930,577 | A | | 7/1999 | Forsthoefel et al. | 399/401 |
| 5,994,711 | A | | 11/1999 | Seachman et al. | 250/559.36 |
| 6,006,065 | A | * | 12/1999 | Seki | 399/407 |
| 6,116,594 | A | | 9/2000 | Boost | 271/236 |
| 6,137,989 | A | | 10/2000 | Quesnel | 399/394 |
| 6,148,172 | A | | 11/2000 | Kanda et al. | 399/391 |
| 6,160,981 | A | | 12/2000 | Williams et al. | 399/304 |
| 6,168,153 | B1 | | 1/2001 | Richards et al. | 271/227 |
| 6,168,333 | B1 | | 1/2001 | Merz et al. | 400/634 |
| 6,173,952 | B1 | | 1/2001 | Richards et al. | 271/228 |
| 6,608,990 | B1 | * | 8/2003 | Gonnella et al. | 399/382 |

FOREIGN PATENT DOCUMENTS

| | | |
|---|---|---|
| EP | 1 002 652 A2 | 5/2000 |

OTHER PUBLICATIONS

Eastman Kodak Company, User's Guide Part No. 950098, Kodak 1570 and 1575 Copier-Duplicators, May 1991.

Eastman Kodak Company, Publication No. TG9600-1, Theory Guide for the Kodak 1570/1575 Copier-Duplicators, Nov. 1992.

Eastman Kodak Company, Publication No. TG9600-2, Finisher Theory of Operation for the Kodak 1570 and 1580 Copier-Duplictors, Jul. 1992.

* cited by examiner

POST PROCESSOR INSERTER SPEED AND TIMING ADJUST UNIT

FIELD OF THE INVENTION

This invention generally relates to image-forming production systems. More particularly, this invention relates to improving the operation of combining one or more sheets before they arrive at a finisher device in the image-forming production system.

BACKGROUND OF THE INVENTION

Image-forming production systems, such as electrophotographic printers, are used to transfer images onto a plurality of sheets of paper or other medium. In a typical image-forming job, the image-forming production system transfers or prints one or more images onto one or more sheets. When multiple images are transferred, the image-forming process usually transfers the images to arrange the output sheets according to the image-forming job. The output sheet sequence typically corresponds to the image input sequence into the image-forming production system. This ordered input and corresponding output-avoids the need to reassemble or otherwise compile the sheets.

Many image-forming production systems, such as electrophotographic printers, have a marking engine, an inserter, and a finisher device. The marking engine transfers images onto the sheets. If required by the image-forming job, the inserter inserts a preprinted or blank sheet into the sheet output from the marking engine. The finisher device collects the output sheets to complete the image-forming job or prepare it for subsequent processing operations. In some image-forming jobs there may be a need to combine or merge imprinted sheets from the marking engine with plain sheets or sheets that do not require imaging. For such printing jobs, an insert supply or an inserted sheet may be placed downstream of the marking engine, between the marking engine and other output accessories from an inserter. There are image-production systems that are capable of combining the plain sheets from the inserter with the imprinted sheets. For the reasons which follow, the speed of sheets exiting from the marking engine may not match the output speed of the inserter. Additionally, the speed at which sheets are supplied to the inserter may be faster than the speed at which output devices can accept sheets. In more detail, in an electrophotographic marking engine, it is desirable to minimize the speed at which an image is processed and fused for a given throughput rate. The speed is minimized by positioning the sheets relatively close to each other in the feed direction on the image loop. However, for high speed inserters, vacuum feeding from supply trays to the inserter is generally preferred due to its superior reliability and performance. For maximum performance, the vacuum devices feeding the inserter require a significant time between sheets in order to safely acquire a sheet with vacuum prior to feeding. To maximize the time between sheets, the sheets are fed to the inserter at a high speed, leaving more time between feeds to acquire the next sheet. Since the sheets being fed to the inserter will be merged, in appropriate places, between sheets from the marking engine, the lower speed requirements of the marking engine are at conflict with the higher speed requirement of the inserter vacuum feed system. Merging sheets traveling at two different speeds present obvious problems.

Additionally, the high feeding speed for the inserter may be problematic for output accessories. Some output accessories or devices, such as devices that perform stacking, stapling or folding require a relatively large amount of time to accomplish these functions. Therefore, the input speed to these devices conflicts with the high speed vacuum feed speed of the inserter.

Further, some output devices such as hole punchers require as much uniformity between sheets as possible. For these devices, it is important to make the leading edge timing of sheets exiting the inserter as uniform as possible.

Accordingly, there is a need for an image-production system that is able to combine sheets from different parts of the image-production systems for a high-speed image forming job, where the merging of sheets occur at a time that is coordinated with the timing of the marking engine. There is also a need to have output devices receive sheets with uniform timing.

BRIEF SUMMARY OF THE INVENTION

In the present invention, an image-forming production system includes a marking engine that prints an image onto a sheet. The marking engine has an output which feeds the printed sheet at a first speed. An inserter connected to the marking engine receives the printed sheet from the marking engine output. The inserter has an inserter supply that feeds an insert sheet to be placed sequentially with the printed sheet in a print job. The insert supply feeds the insert sheet to the inserter at a second speed. An inserter speed adjust unit sequentially receives the printed sheet at the first speed and the insert sheet at the second speed and outputs both at a third speed.

BRIEF DESCRIPTION OF SEVERAL VIEWS OF THE DRAWINGS

These and other advantages of the present invention will become more apparent as the following description is read in conjunction with the accompanying drawings, wherein.

DETAILED DESCRIPTION OF THE INVENTION

Figure 1:
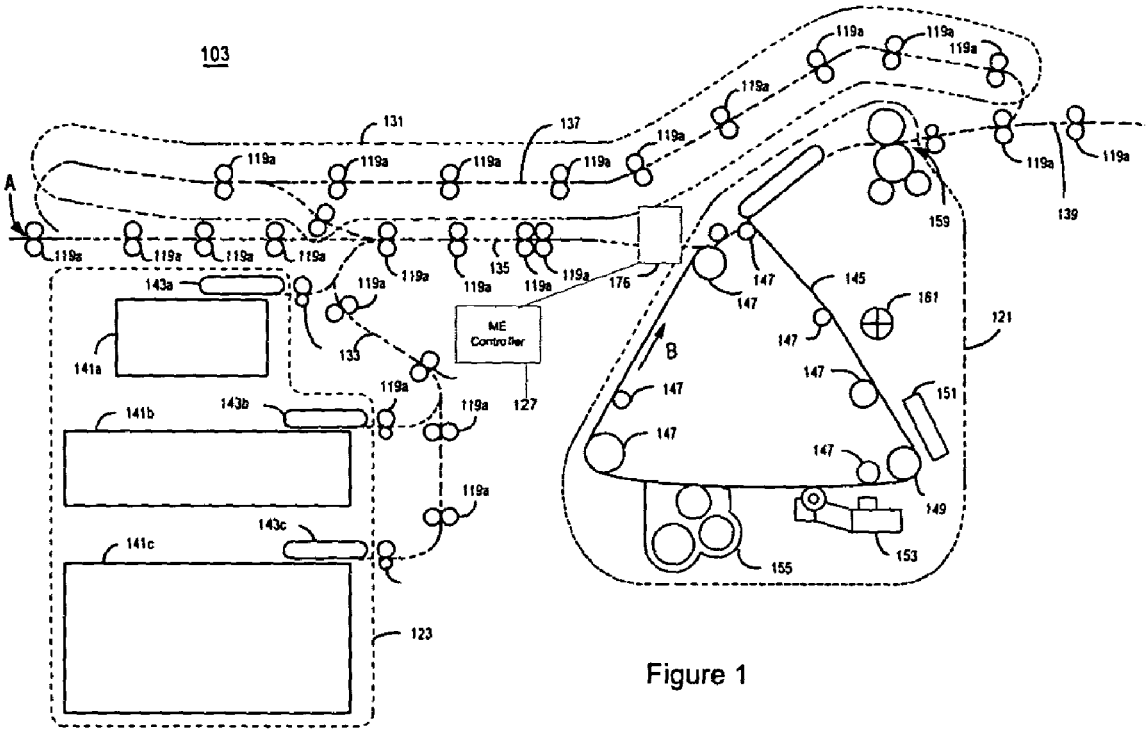
FIG. 1 is a schematic diagram of a preferred embodiment of a marking engine of the image-forming production system.

The present preferred embodiments of the invention are described herein with reference to the drawings, where like components are identified with the same reference numerals. These descriptions are intended to be exemplary, in nature and are not intended to limit the scope of the invention.

Figure 2:
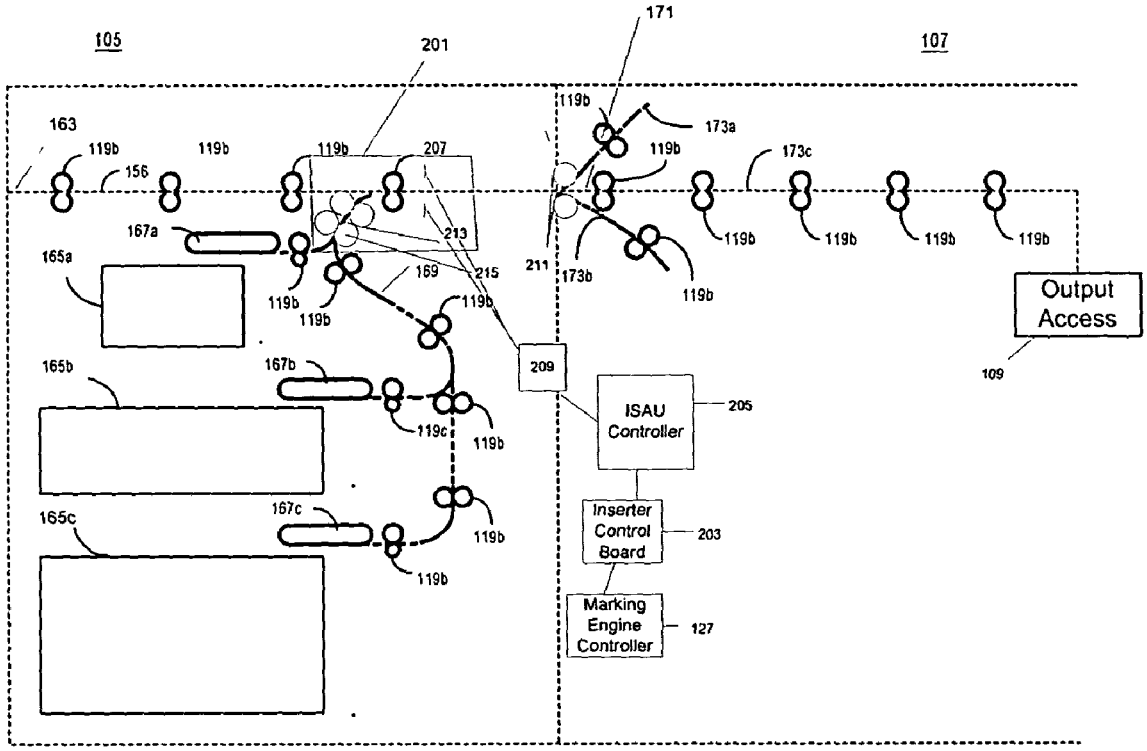
FIG. 2 is a schematic diagram of a preferred embodiment of a inserter and a finisher device of the image-forming production system.

Referring now to the figures, image-forming production system 100 includes a marking engine 103 (FIG. 1), an inserter 105 (FIG. 2), a finisher device 107 (FIG. 2), and an output accessory 109 (FIG. 2).

FIG. 1 is a schematic diagram of a preferred embodiment of a marking engine of the image-forming production system. The marking engine 103 is a module that prints the desired image on the paper or other medium, it is also referred to as an electrophotographic process module. Preferably, the marking engine 103 includes an imaging unit 121, a feeder assembly 123 and a marking engine controller 127. Imaging unit 121 may also be referred to as an imaging system. The marking engine may also include an inverter 131 interconnected by paper transports 133, 135, 137 and 139. In this preferred embodiment, paper transport 135 receives the sheet from paper transport 133.

The paper transports 133, 135, 137 and 139 may be any suitable conveyance mechanism for moving sheets throughout the marking engine 103. For example, the paper transports 133, 135, 137 and 139 may have roller sets, a belt, linked plate, or other suitable configuration. The paper transports 133, 135, 137 and 139 may be solid or perforated, and may work with pressurized air, a vacuum or combination system to keep the sheets in position such as against the paper transport. Guides and similar devices (not shown) may be present to divert or direct the sheets onto another paper transport or in a particular direction. The paper transports 133, 135, 137 and 139 operate in conjunction with paper transport rollers 119*a*, of which any one or more may be a motor driven roller. In the disclosed embodiment, the paper transport rollers 119*a* are configured in pairs oppositely disposed on the paper transports 133, 135, 137 and 139. The paper transport rollers 119*a* may have other configurations suitable for moving the sheets. Alternatively, the paper transports 133, 135, 137 and 139 may be a passage or path for the sheets to follow. The paper transport rollers 119*a* may be disposed such that at least one roller or one pair of rollers is in contact with each sheet at any position along the paper transports 133, 135, 137 and 139.

Preferably, feeder assembly 123 supplies paper or other medium to the imaging unit 121. The feeder assembly 123 is preferably of the vacuum feed type. As discussed above, vacuum feed is preferred because of its superior reliability and performance compared to other types of feeding devices. The marking engine 103 may have a feeder position A to bypass the feeder assembly 123. At feeder position A, a user may feed a sheet or other medium onto the input paper transport 135. The feeder assembly 123 includes one or more sheet storage bins 141*a*, 141*b*, and 141*c* having one or more paper feeder(s) 143*a*, 143*b*, and 143*c*, respectively. Paper feeders may be referred to as sheet feeders.

The sheet storage bins 141*a*, 141*b*, and 141*c* hold sheets of paper or other medium. There may be other multiples of sheet storage bins, including those of different sizes. The sheets may be the same, different and a combination of sizes. The sheets also may be the same, different and a combination of paper and other medium.

In operation, the paper feeders 143*a*, 143*b*, and 143*c* extract a sheet from the storage bins 141*a*, 141*b*, and 141*c* and dispense the sheet onto a paper transport 133. The paper transport 133 moves the sheet onto the input paper transport 135, which transports the sheet to the imaging unit 121.

The imaging unit 121 is the site in the marking engine 103 where the images are transferred or imprinted onto the sheets of paper. The imaging unit 121 may be a component of a copy machine, a facsimile machine, an electrophotographic image-forming machine, and the like.

A registration system assembly 176 aligns the sheet to the photoconductor or image loop in the correct position and orientation and at the correct time for imaging. For example, the registration system 176 corrects the skew, timing and crosstrack position of sheets before they are transferred to the image loop of the marking engine 103. More specifically, registration rollers in the registration system 176 adjust the skew, timing and crosstrack position of the sheets so that paper arrives with appropriate orientation at the imaging unit 121.

In one embodiment, the imaging unit 121 includes a photoconductor 145, support rollers 147, a motor driven roller 149, a primary charger 151, an exposure machine 153, a toning station 155, a fusing station 159, a cleaner 161, related equipment and accessories. The photoconductor 145 is operatively mounted on the support rollers 147. The motor driven roller 149 moves the photoconductor 145 in the direction indicated by arrow B. The primary charger 151, the exposure machine 153, the toning station 155, the fusing station 159, and the cleaner 161 are operatively disposed adjacent to the photoconductor 145. Preferably, the photoconductor 145 has a belt and roller-mounted configuration, but may have a drum or other suitable configuration.

To form an image, the primary charger 151 electrostatically charges the photoconductor 145 and the exposure machine 153 optically exposes and forms an electrostatic image on the photoconductor 145. The toning station 155 applies charged toner on the photoconductor 145. The charge on the toner causes it to adhere to the electrostatic image. A transfer charger transfers the toner from the photoconductor 145 onto a sheet. The fusing station 159 then receives the sheet from the transfer charger and fuses the toner to the sheet to define a printed sheet.

Referring to FIG. 1, an inverter 131 may be provided in the marking engine 103 to make duplex sheets. The inverter 131 is not used when a duplex sheet is not to be produced. The inverter 131 includes an inverter paper transport 137, which may be any suitable mechanism for inverting the sheets. The inverter 131 turns the duplex sheet upside down prior to transferring the duplex sheet onto the input paper transport 135. The inverter 131 may have a transfer tray (not shown) or similar device to assist inverting the duplex sheet. After a first image is transferred onto a first side of a duplex sheet, the duplex sheet exits the imaging unit 121 on the output paper transport 139. The duplex sheet is then diverted onto the inverter paper transport 137, which inverts the duplex sheet and delivers the duplex sheet to the input paper transport 135. The duplex sheet enters the imaging unit 121 where a second image is transferred onto a second side of a duplex sheet. The duplex sheet exits the imaging unit 121 and the marking engine 103 on the output paper transport 139 which is the output of the marking engine 103, bypassing the inverter 137.

A preferred embodiment of an arrangement for a an inserter and a marking engine is disclosed in U.S. patent application Ser. No. 60/414,788 entitled "Pre-Registration Speed and Timing Adjust", filed Sep. 27, 2002, the entire contents of which are incorporated herein by reference.

FIG. 2 is a schematic diagram of a preferred embodiment of a post processor (i.e., a post imaging unit inserter) inserter and a finisher device of the image-forming production system. As shown, the post processor inserter 105 is disposed downstream of the marking engine 103. Sheets exiting the marking engine 103 on the output paper transport 139 are then transferred to a pass-through paper transport 163 as the sheets enter the post processor inserter 105. The output paper transport 139 and the pass-through paper transport 163 form a sheet output path and may be the same paper transport. The sheet output path may include the output paper transport 139 or may include other paper transports, such as one or more finisher paper transports 173*a*, 173*b*, and 173*c*.

The inserter 105 is an auxiliary paper module that merges sheets from the insert supplies with those coming from marking engine 103 upstream from the finisher device 107. If there are no insert sheets in the image-forming job, the sheets exit the inserter 105 and enter the finisher device 107. If there are insert sheets, the inserter 105 places sequentially the inserted sheets between the appropriate output sheets from the marking engine 103.

Preferably, the inserter 105 includes insert storage bins 165*a*, 165*b*, and 165*c* having insert paper feeders 167*a*, 167*b*, and 167*c*, respectively. Preferably, the inserter 105 is of the vacuum feed type. At the appropriate position in the sheet output from the marking engine 103, an insert sheet position, one or more of the insert paper feeder(s) 167*a*, 167*b*, and 167*c* provides inserted sheets to the insert paper transport 169 from one or more of the storage bins 165*a*, 165*b*, and 165*c*. The sheet storage bins 165*a*, 165*b* and 165*c* may be the same or different sizes and hold insert sheets, which may be different sizes, blank, preprinted and the like or a combination of paper and other medium. For example, sheets may be tabs, paper transparencies, cardboard, poster board, and the like.

In operation, the insert paper feeders 167*a*, 167*b*, and 167*c* extract an insert sheet from the storage bins 165*a*, 165*b*, and 165*c* and dispense the insert sheet onto the inserter paper transport 169. The insert paper transport 169 provides a means for transferring the one or more sheets (plurality of sheets) onto a pass-through paper transport 156. The paper transports 156 and 169 operate in conjunction with paper transport rollers 119*b*, of which any one or more may be a motor driven roller. The paper transport rollers 119*b* may be configured in pairs oppositely disposed on the paper transports 156 and 169. The paper transport rollers 119*b* may have other configurations known in the art suitable for moving the sheets. Alternatively, the paper transports 156 and 169 may provide a passage or path for the sheets to follow. The paper transport rollers 119*b* may be disposed such that at least one roller or one pair of rollers is in contact with each sheet at any position along paper transports 156 and 169.

The paper transport 156 transfers the one or more inserted sheets and one or more printed sheets exiting the output of the inserter 105 to paper transport 171 of the finisher device 107. Finisher entrance rollers 211 accepts the sheets before they enter the finisher device. The inserter paper transport 169 provides the inserted sheets onto the paper transport 156.

Figure 3:
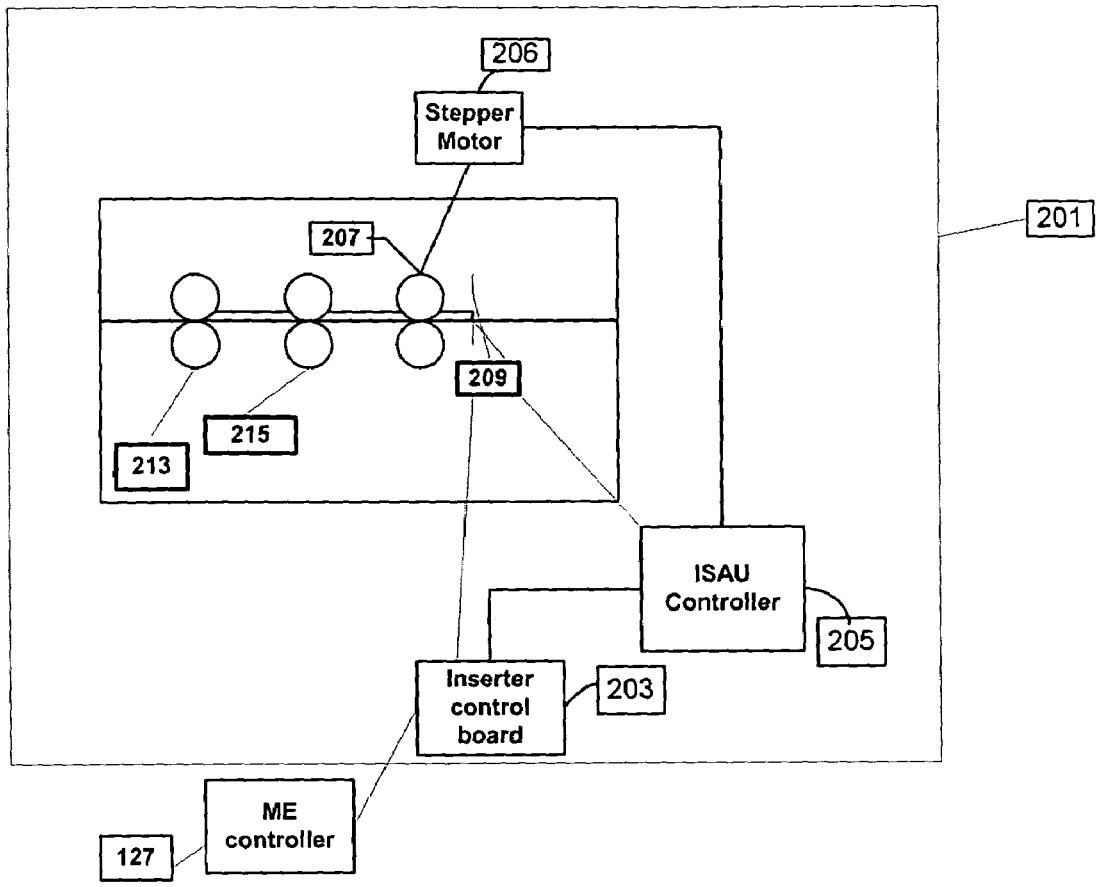
FIG. 3 is a schematic diagram of a preferred embodiment of an inserter speed adjust unit connected to a marking engine controller.

The inserter 105 also includes an inserter speed adjust unit 201. It would be recognized that the inserter speed adjust unit 201 may be a unit separate from or outside of inserter 105. FIG. 3 is a schematic diagram of a preferred embodiment of an inserter speed adjust unit 201. The inserter speed adjust unit 201 is located downstream from the marking engine 103. In this embodiment, inserter speed adjust unit 201 includes upstream nip rollers 213, upstream nip rollers 215, speed adjust rollers 207, ISAU controller 205, an inserter control board 203 and at least one inserter speed adjust unit (ISAU) sensor 209.

In addition, the ISAU sensor 209 is operatively connected to the ISAU controller 205 and the inserter control board 203. ISAU controller 205 is connected to the inserter control board 203. The inserter control board 203 is operatively connected to marking engine controller 127. ISAU controller 205 controls the operation of the speed adjust rollers 207 in the ISAU 201 based on information the ISAU controller 205 receives from the ISAU sensor 209. In the preferred embodiment, the ISAU 201 corrects or adjusts the timing of sheets for paper feeders 167*a*, 167*b* and 167*c* relative to the timing of the sheets at the output of the marking engine 103 or paper transport 139 received from the paper feeder 143*a*, 143*b* and 143*c* prior to delivering the sheets to the finisher entrance rollers 211.

In this embodiment, speed adjust rollers 207 are connected by at least one belt and pulleys to a stepper motor 206 that is connected to the ISAU controller 205. The ISAU controller 205 uses the stepper motor 206 to control the speed of speed adjust rollers 207 to correct the timing of sheets arriving at the finisher entrance rollers 211 which here defines output of the inserter 105. In this manner, the ISAU 201 can accurately combine the sheets from the marking engine 103 and inserter 105 before the sheets are output at the finisher entrance rollers 211. In addition, ISAU controller 205 uses the stepper motor 206 to control the speed of adjust rollers 207 to adjust the speed at which the sheet(s) arrive at the finisher device 107. In this manner, the ISAU 201 can accurately position the paper for combination with other paper from different parts of the image-forming production system, such as marking engine 103.

In a preferred embodiment, the ISAU controller 205 is located inside or part of the inserter control board 203. In an alternative embodiment, inserter control board 203 is located inside or part of the marking engine controller 127.

Preferably, the marking engine controller 127 is connected to a user interface that allows a user to control the operation of the image-forming production system 100. The user interface may be a graphical user interface or any suitable user interface.

Referring to FIG. 2, preferably, a finisher device 107 is provided that collects the sheet output to complete the image-forming job or prepare it for subsequent processing operations, such as stapling, binding, collation and the like. The finisher device receives the sheets output from the inserter 105 after they pass through the inserter speed adjust unit 201. In the finisher device 107, the sheets are transferred onto one of the finisher device paper transports 173*a*, 173*b*, and 173*c*. Each of the finisher device paper transports 173*a*, 173*b*, and 173*c* may lead to one or more finishing operations (not shown), such as stapling, binding, collation, and the like. One of the finisher paper transports 173*a*, 173*b*, and 173*c* may be the same as the pass-through paper transport 171. The finisher device 107 transfers the sheets along the paper transport rollers 119*b* to an output accessory 109, which is used to facilitate the presentation of the sheets in a document or a print job in any particular manner. One or more optional output accessories 109 may be located downstream of the finisher device 107.

Figure 5:
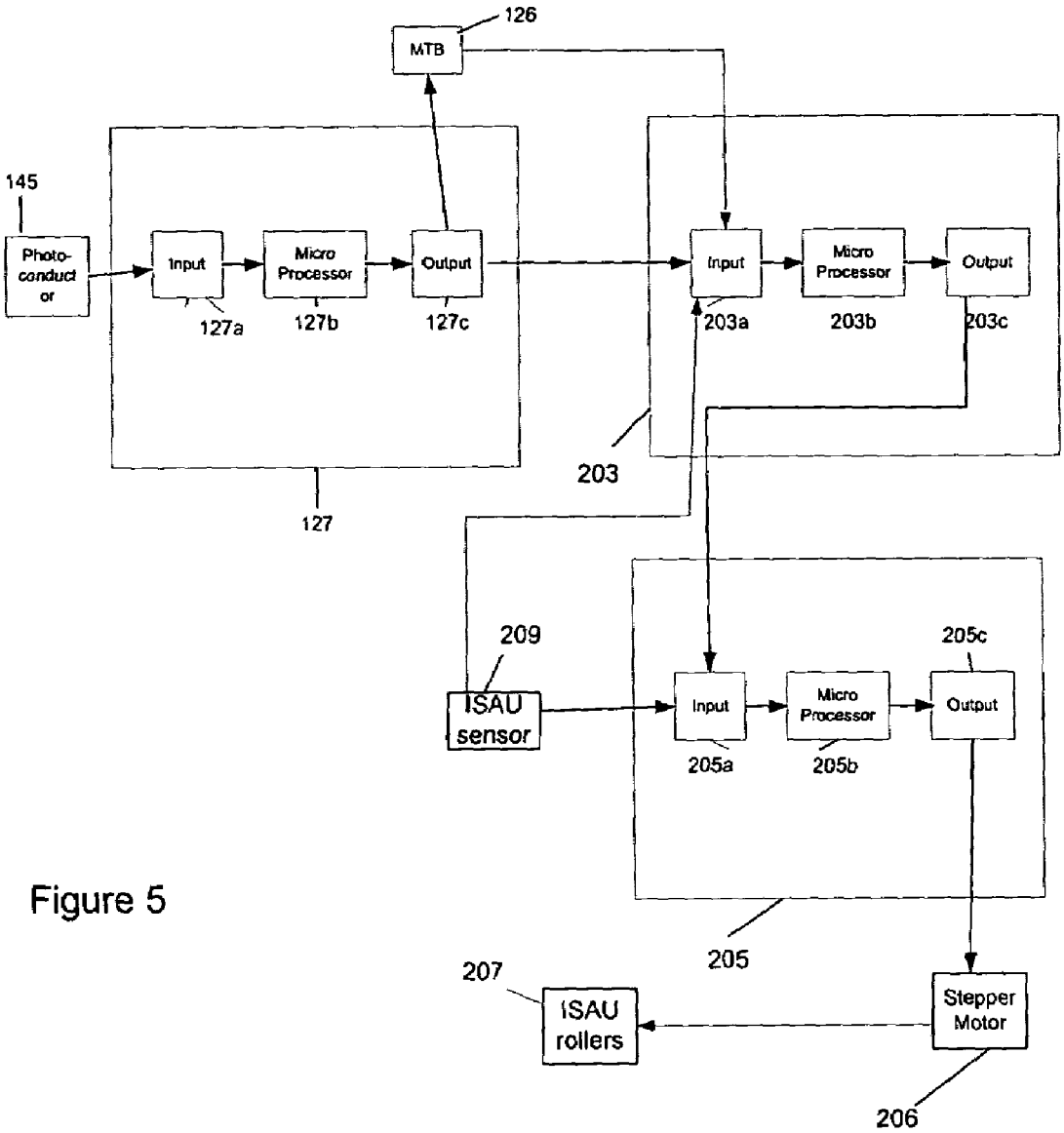
FIG. 5 is a schematic diagram of a preferred embodiment of an insert speed adjust unit controller, an inserter control board and a marking engine controller.

FIG. 5 is a schematic diagram of a preferred embodiment of an ISAU controller connected to an inserter control board, which in turn is connected to a marking engine controller. The ISAU controller 205 is operatively connected to inserter control board 203, which in turn is operatively connected to marking engine controller 207. The ISAU controller 205 and the inserter control board 203 interacts with the ISAU sensor 209 to measure the arrival time of the paper or medium at the ISAU 201. ISAU controller 205 controls the movement of the paper in the ISAU 201 by controlling a stepper motor 206, which controls the movement of the speed adjust rollers 207 shown in FIG. 3.

Marking engine (ME) controller 127 is responsible for coordinating the actions of several subsystems within the marking engine 103, such as the imaging unit 121. The ME controller 127 includes an input interface 127*a*, a microprocessor 127*b*, an output interface 127*c*, where all the components are connected to each other in any suitable combination. In the preferred embodiment, microprocessor 127*b* is an M68332 processor. The ME controller 127 is connected through its input interface 127*a* to various components and sensors in the marking engine 103, such as a sensor input (not shown) that is close to a photoconductor 145 of imaging unit 121. The sensor input senses the perforations or indexes on the photoconductor 145. Each time the sensor input senses a perforation on the photoconductor 145 the input interface 127*a* receives a signal corresponding to the perforation and the microprocessor 127*b* generates an F-PERF signal. The microprocessor 127*b* sends the F-PERF signal through output interface 127*c* to a Machine Timing Bus (MTB) 126. The photoconductor 145 is driven by rollers 147 that include an encoder. The encoder generates 600 encoder counts per inch the photoconductor 145 travels. The ME controller 127 is connected by the input interface 127*a* to the encoder so the ME controller 127 receives encoder counts and through its output interface 127*c* places the counts on the MTB 126. The input interface 127*a* also monitors the actions of the subsystems for fault conditions in the wiring of the subsystems.

Preferably, MTB 126 is a digital circuit, which provides a means to coordinate the timing of the subsystems in marking engine 103. The input interface 127*a* also performs other functions, such as receiving information from other subsystems in the marking engine 103, for example the imaging unit 121.

The output interface 127*c* is responsible for taking commands from microprocessor 127*b*, and putting it into a form capable of commanding the various components in the marking engine, such as the imaging unit 121.

The microprocessor 127*b* may also include a clock/timing circuit, an electronic erasable program read only memory (EEPROM) or Flash memory, static random access memory (RAM) and a read only memory (ROM). The microprocessor 127*b* also includes a software program that enables it to continuously monitor and read measurements from the input interface 127*a* connected to various systems in the marking engine 105, such as the sensor input on the photoconductor 145.

The inserter control board 203 includes an input interface 203*a*, a microprocessor 203*b*, and an output interface 203*c*, where all the components are connected to each other in any suitable combination. The inserter control board 203 is responsible for the overall operation of the inserter 105 and manages the low level details of feeding insert sheets from paper feeders 167*a*, 167*b* and 167*c* and transporting the sheets through the inserter 105.

In addition, input interface 203*a* is connected to output interface 127*c*. The inserter control board 203 may receive instructions from the ME controller 127 by utilizing its input interface 203*a* to receive instructions from the output interface 127*c*. For example, the ME controller 127 may instruct the inserter control board 203 to feed an insert into the next frame, etc. In another example, the input interface 203*a* generates a synch pulse signal based on the F-PERF signals received from MTB 126, which in turns transmits the synch pulse signal to microprocessor 203*b*. Microprocessor 203*b* then transmits the signal to the output interface 203*c* that transmits the synch pulse signal to input interface 205*a*. Subsequently, the input interface 205*a* transmits the synch pulse signal to the microprocessor 205*b*. Inserter control board 203 is connected by its input interface 203*a* to the ISAU sensor 209 in the ISAU 201. When a lead edge of the sheet(s) or medium contacts the ISAU sensor 209, the ISAU sensor 209 transmits a signal to the speed ISAU controller 205 that "paper is present."

In the preferred embodiment, microprocessor 203*b* is an M68332 processor. The microprocessor 203*b* may also include a clock/timing circuit, an electronic erasable program read only memory (EEPROM) or flash memory, static random access memory (RAM) and a read only memory (ROM). The microprocessor 203*b* also includes a software program that enables it to continuously monitor and read measurements from various components in the inserter 105. The microprocessor 203*b* is also connected to the output interface 203*c*. The output interface 203*c* is responsible for taking commands from microprocessor 203*b*, and putting it into a form capable of commanding the various components in the inserter 105, such as the ISAU controller 205.

The ISAU controller 205 includes an input interface 205*a*, a microprocessor 205*b*, and an output interface 205*c*, where all the components are connected to each other in any suitable combination. The ISAU controller 205 is connected to inserter control board 203 by the connection of its input interface 205*a* to output interface 203*c*. The ISAU controller 205 controls the operation of the ISAU 201 based on information the speed ISAU controller 205 receives from the ISAU sensor 209 and the synch pulse signal received from the inserter control board 203.

The input interface 205*a* is connected to the output interface 203*c*, which enables the ISAU controller 205 to receive synch pulse signals from inserter control board 203. ISAU controller 205 is connected by its input interface 205*a* to the ISAU sensor 209 in the ISAU 201. When a lead edge of the sheet(s) or medium contacts the ISAU sensor 209, the ISAU sensor 209 transmits a signal to the speed ISAU controller 205 that "paper is present."

In this embodiment, the microprocessor 205*b* is an 8051 processor. The microprocessor 205*b* may also include a clock/timing circuit, an electronic erasable program read only memory (EEPROM) or flash memory, static random access memory (RAM) and a read only memory (ROM).

The microprocessor 205*b* also includes a software program that enables it to measure the time from the synch pulse signal and the time of the signal from the speed adjust sensors as an actual measured time. The microprocessor 205*b* then compares the actual measured time to a nominal time to calculate when to adjust the travel speed of the sheets. In the preferred embodiment, the nominal time is 120 seconds. The nominal time is a theoretical time from when a synch pulse signal is sent to microprocessor 205*b* to when a lead edge of at least one sheet from marking engine 103 or inserter 105 should contact the ISAU sensor 209. This nominal time is preferably determined and stored in the memory of microprocessor 205*b*. The microprocessor 205*b* through the output interface 205*c* commands the stepper motor 206 to change or adjust the speed of speed adjust rollers 207, which adjusts the speed of the sheets.

In an alternative embodiment, the ISAU controller 205 and the inserter control board 203 is located inside or part of the marking engine controller 127. Preferably, the marking engine controller 127 is connected to a user interface, as described above, that allows a user to control the operation of the image-forming production system 100. The user interface may be a graphical user interface or any suitable user interface.

Figure 4:
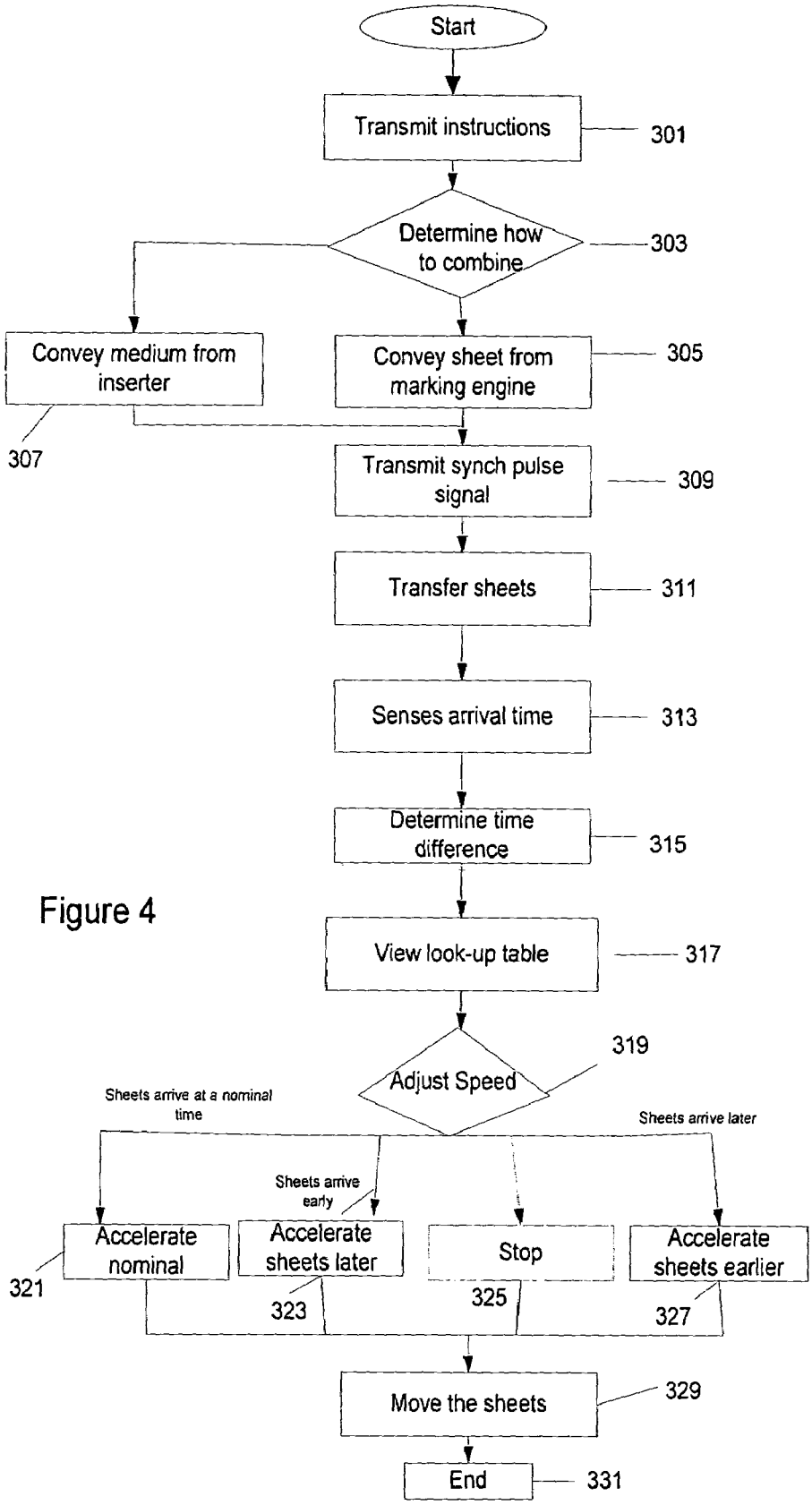
FIG. 4 is a flow chart of an algorithm or method that provides an example of how the inserter speed adjust unit is utilized in the image-forming production system.

FIG. 4 is a flow chart of an algorithm or method that illustrates how the invention is utilized in the image-forming production system 100. The user may initiate a desired combination of the sheets or any type of medium from the marking engine 103 or inserter 105. The paper or medium from the inserter, marking engine or any other paper supply may be combined in any suitable manner.

In an example, at 301, at a user interface (not shown) a user may program or provide instructions to the image-forming production system 100 to combine eighteen sheets of paper from marking engine 103 and 2 photographs from one of the insert supplies or paper feeders at the inserter 105 before the eighteen sheets and the photographs are sent to the finisher device 107 for binding. This combination process may also be initiated by another job control mechanism that controls marking engine 103 and/or inserter 105. In this instruction, the eighteen sheets and photographs are combined in a stack, for example sheets 1–9 of the eighteen sheets are on the bottom of the stack, the first photograph is on top of the ninth sheet, the sheets 10–18 are on top of the first photograph and the last photograph is on top of the eighteenth sheet. Nominal feed timing systems in the inserter 105 and the marking engine 103 control the time the sheets leave and travel to the inserter speed adjust unit (ISAU) 201.

In this example, at 303, the ME controller 127 receives the instructions at input interface 127*a*, which in turn transmits the instruction to microprocessor 127*b*. Microprocessor 127*b* analyzes the instruction to decide how the eighteen sheets and the photographs or the medium should be combined. This combination occurs simultaneously between the bypass sheets at the marking engine 103 and the insert sheets at inserter 105, where the insert sheets and the bypass sheets are spaced at a regular time interval in order for productivity and efficiency to be maximized. At 305, based on the received instructions, marking engine 103 transfers sheets 1–9 of the eighteen sheets or bypass sheets along paper transports 133, 135 to the insert speed adjust unit (ISAU) 201. The sheets 1–9 are dispensed from one or more of the paper feeders 143*a*, 143*b* and/or 143*c* and they travel along paper transports 133, 135 to the ISAU 201. Before sheets 1–9 arrive at the ISAU 201 the at least one sheet from the sheets passes through registration system 176 and the imaging unit 121, where the sheet may be imprinted with any suitable image.

Alternatively, at 307, the instructions may indicate that at least one photograph or insert sheet should be conveyed from paper feeders 167*a*, 167*b* and 167*c* of inserter 105, then the at least one photograph is conveyed along paper transports 169 and 156 to ISAU 201.

For each of the sheets or photograph from the marking engine 103 or inserter 105, after a period of time the inserter control board 203, preferably, receives at its input interface 203*a* predetermined number of encoder counts from MTB 126, for example 3975 encoder counts, after an F-PERF signal to indicate that the at least one sheet from the sheets or at least one photograph is approaching the ISAU 201.

At 309, the inserter control board 203 after receiving the predetermined number of encoder counts transmits a synch pulse signal from output interface 203*c* to input interface 205*a*. These synch pulse signals provide an indication of where the sheets or photographs are coming from in the transports 143*a*, 143*b* and/or 143*c* of marking engine 103 or transports 167*a*, 167*b* and/or 167*c* of inserter or some other paper supply. The input interface 205*a* transmits the synch pulse signal to the microprocessor 205*b* of the ISAU controller 205. The microprocessor 205*b* receives the synch pulse signal, at the input interface 205*a*, that indicates the at least one sheet from the sheets or at least one photograph is approaching the ISAU 201. The signal is a basis from which to start measuring a time period. The synch pulse signal also serves as a reference point that indicates when the sheet or photograph should arrive at ISAU 201.

In FIG. 4 at 311, the paper transport 135 transfers the at least one sheet from sheets 1–9 to the ISAU 201. The at least one sheet from sheets 1–9 or photograph pass through speed adjust rollers 207 as the sheet travels towards the ISAU sensor 209 in the ISAU 201. After the sheet passes through the speed adjust rollers 207, the leading edge of at least one of the sheet from the sheets 1–9 contacts the ISAU sensor 209.

At 313, the ISAU sensor 209 senses the arrival of the sheets passing through the ISAU 201 and transmits the arrival as a signal that indicates arrival to the input interface 205*a*, which in turn transmits the signal to microprocessor 205*b*. For example, when the leading edge of the sheet contacts the ISAU sensor 209, then the ISAU sensor 209 transmits a signal that there is "paper present" to the ISAU controller 205 and inserter control board 203.

At 315, the microprocessor 205*b* determines an arrival time of the signal from the ISAU sensor 209. The microprocessor 205*b* then determines the time from the synch pulse signal to at least one sheet from the sheets contacting the ISAU sensor 209. Then the microprocessor 205*b* determines a time difference to the nominal time between the synch pulse signal and the arrival time. In a preferred embodiment, the nominal time is 120 milliseconds.

At 317, microprocessor 205*b* either uses a calculation or a look up table stored on ISAU controller 205 to look up the measured time and find a time to transition the speed adjust rollers (an adjust time) from the 25 inches per second (ips) first input speed of the incoming at least one sheet from sheets 1–9 to the desired second output speed of the sheet, for example 38 ips.

At 319, microprocessor 205*b* instructs the stepper motor 206 to adjust the speed of the speed adjust rollers 207 based on where the at least one sheet of the sheets or photograph comes from. For example, if the sheet comes from the marking engine 103 the speed adjust rollers 207 may be turning at 25 ips, which is adjusted to 38 ips or third speed in order that the sheets arrive at the finisher entrance rollers 211 at a regular period. Depending on the arrival time of the sheet at the ISAU 201, there are four ways that the travel speed of the sheets may be adjusted as shown in options 321, 323, 325 and 327.

At 321, the at least one sheet of the sheets arrive at the nominal time and the speed of the speed adjust rollers 207 is accelerated from the speed of the incoming sheets to the desired output speed of the ISAU 201 (such as 38 ips) at the calculated adjust time to feed the sheet to the downstream output accessories at the appropriate timing. The nominal time is 0.030 seconds after the at least one sheet arrives or contacts the ISAU sensor 209.

Since the sheets must arrive at the downstream output accessories at consistent timing intervals, if sheets arrive early or late relative to the nominal time, the ISAU 201 will also adjust the timing of the sheets exiting the speed adjust rollers 207. If the sheet arrives early as shown at 323, ISAU controller 205 instructs the speed adjust rollers 207 to accelerate the sheet later. In this manner, the sheets are driven at the lower speed for a longer time in order to delay the sheet the appropriate amount. In an example, if the leading edge of at least one of the sheets is detected at the ISAU sensor 209 at 15 milliseconds after the synch pulse signal is sent to the ISAU controller 205, then the ISAU controller 205 instructs the stepper motor 206 to decelerate the speed adjust rollers 207 at 15 milliseconds after the sheet is detected by the ISAU sensor 209. The following calculation is used to determine when the speed adjust rollers 207 should accelerate the sheet: 30 ms+((38 ips/(25 ips−38 ips))*120 ms−115 ms)=15 ms.

If the at least one sheet arrives later than the nominal time, as shown at 327, the ISAU controller 205 instructs the speed adjust rollers 207 to decelerate the sheet later. In this manner, the sheet is driven at the higher speed for a longer time in order to make up the timing difference. For example, if the leading edge of the sheets is detected at the ISAU sensor 209 at 125 milliseconds rather than the nominal time of 120 milliseconds, then ISAU controller 205 instructs the stepper motor 206 through the speed adjust rollers 207 to decelerate the sheets 45 milliseconds after it is detected by the speed adjust unit sensor 209. The following calculation is used to determine when the speed adjust rollers 209 should decelerate the sheets: 45 ms=30 ms+((38 ips/(25 ips−38 ips))*120 ms−125 ms).

In this embodiment, the maximum theoretical adjustment range is determined by the difference in input and desired speeds, the distance from the ISAU sensor 209 and the entrance sensor (not shown) to the downstream device, and the distance required to decelerate the sheet. Thus, this embodiment is appropriate when there is a small amount of timing variations expected and the primary purpose of the speed adjustment is to change the speed of the sheet.

In another embodiment, the timing latitude is increased by using a larger speed differential for the speed adjust rollers 207. In this embodiment, the speed of the speed adjust rollers 207 is controlled to a level (a fourth speed) that is higher than the input speed for the sheets that arrive too late to otherwise correct. For instance, for every millisecond the sheets are transported at 3 times the output speed of 99 ips, 2 milliseconds will be saved.

Similarly, the sheets are driven at a speed lower than the output speed for sheets that arrive too early. For example, if the plurality of sheets arrive too early to correct by accelerating the output speed of the speed adjust rollers 207 to 38 ips immediately after the sheets arrive at the speed adjust sensor 209, the ISAU controller 205 can instruct the speed adjust rollers 207 to slow down the sheets to a speed even less than that of the output speed of 38 ips to compensate for the additional "earliness" of the sheets. If the speed adjust rollers 207 are moving at a speed less than the output speed of 38 ips, more time will be used to transport the sheets the same distance and thus "early" sheets can be corrected. Therefore, the speed of the sheets will be decelerated by the speed adjust rollers 207 to 38 ips and be fed to the output accessories at the appropriate time. This increases the latitude, based on the torque limitations of the motor and the distance required accelerating and decelerating to and from these higher and lower speeds.

In another embodiment, if the medium or at least one photograph is from paper feeders 167*a*, 167*b* and 167 of inserter 105, then the photograph is stopped at the ISAU 201 for a period of time, as illustrated at 325 in FIG. 4. In this embodiment, the at least one photograph is stopped through a predetermined velocity profile after the leading edge of the insert sheet or photograph is detected by the ISAU sensor 209. Preferably, this delay may occur for about 1–50 milliseconds. The insert sheet remains delayed until a predetermined time after the synch pulse. After the pre-determined time, microprocessor 205*b* at ISAU controller 205 instructs the stepper motor 206 to adjust the speed adjust rollers 207 to 38 ips, which feeds the insert sheet at 38 ips towards the output accessories. This method is aggressive on the paper and mechanism, but it has very wide timing latitude. This control scheme is appropriate for systems with larger timing variations or short distance, such as from inserter supplies.

If there is enough distance to compensate for the expected time variability, then if the sheet comes from the inserter 105 the speed adjust rollers 207 may be turning at 66 ips, which is adjusted to 38 ips in order that the sheet arrives at the finisher entrance rollers 211 at a regular period.

In an example, the sheets arrive early and at 323, the microprocessor 205*b* instructs the speed adjust rollers 207 to decelerate the sheets earlier. In this example, a leading edge sheet of the first set of sheets is detected at the ISAU sensors 209 at 85 milliseconds after the synch pulse signal is sent to the ISAU controller 205. The ISAU 201 instructs the stepper motor 206 to decelerate the speed adjust rollers 207 to 0 ips for 1–15 milliseconds after the sheet is detected by the ISAU sensor 209. Then the speed adjust rollers 207 in the ISAU 201 will be accelerated so that the sheet move at 38 ips as delivered to the finisher entrance rollers 211.

Regardless of arrival time, the insert sheet is stopped at the same position and it is started at the same time relative to the synch pulse. The length of delay time or dwell time is dependent on the arrival time. Insert sheets that arrive early are delayed a longer period of time and insert sheets that arrive late are delayed for a shorter period of time.

Since the ISAU 201 has a finite input timing latitude, it is desirable to optimize the nominal feed timing for each of the feed sources. If the propensity for early sheets is the same as that of late sheets, the timing should be adjusted so as to center the adjustment latitude for early and late sheets. In this case, the optimum nominal sheet arrival time is halfway between the nominal actuation of the ISAU sensor 209 and the latest point in time the acceleration of the sheets can be initiated by the speed adjust rollers 207 and still have the sheets arrive at the desired speed of 38 ips at the finisher entrance rollers 211. The range for this optimum nominal sheet arrival time is about 0.120 seconds ±0.010 s. In this embodiment, the acceleration of the sheet is forced to occur regardless of the arrival time at the ISAU sensor 209. When a number of sheets are fed from the marking engine 103, then the average arrival time at the ISAU 201 is measured. Once the average arrival time is determined, then the timing of the synch pulse can be changed so the sheets nominally arrive at the ISAU sensor 209 at 0.120 seconds after the synch pulse. Once the synch pulse is adjusted the feed timing for the inserter supplies or paper feeders 167*a*, 167*b* and 167*c* are adjusted.

A number of insert sheets are fed from inserter supplies 167*a*, 167*b* or 167*c* and the time they arrive at the ISAU sensor 209 relative to the synch pulse is measured. Once the average arrival time is determined, then the insert supply feeding time can be changed so the sheets nominally arrive at ISAU sensor 209 at 0.085 seconds after the synch pulse.

Referring to FIG. 5, speed adjust rollers 207 require peripheral devices to accelerate or decelerate the sheets, such as solenoid clutches (not shown), a solenoid (not shown), a small motor (not shown) and low force rollers (not shown) all of which are positioned next to and operatively connected to nip rollers 213 and 215. In a special case, if the ISAU 201 only accelerates the sheets or never decelerates or stops the sheets over-running clutches (one-way clutches) may be used in the upstream nips to transport the sheets. In a preferred embodiment, paper transport rollers 119*b* act as over-running clutches these paper transport rollers 119*b* are close to paper transport 156. The over-running clutches or paper transport rollers 119*b* does not require any type of control to disengage the sheets. For example, the input interface 203*a* receives information if "paper is present" signal by its connection with the ISAU sensor 209. Input interface 203*a* transmits the signal to the microprocessor 203*b*, which instructs the output interface 203*c* to adjust the speed of the speed adjust rollers 207. Microprocessor 203*b* transmits the instructions through output interface 203*c* to a connection with the solenoid clutches to force the nip rollers 213 and 215 to disengage the at least one sheet from the plurality of sheets passing on paper transport 135 so speed adjust rollers 207 can adjust the travel speed of the sheet. In another example, the microprocessor 203*b* transmits instruction through the output interface 203*c* to a connection with the solenoid or a small motor to open up the nip rollers 213 and 215 to allow the speed adjust rollers 207 to adjust the travel speed of the sheet. In yet another example, the low force rollers let the sheet slip through it but it cannot stop the sheet from passing through it so the speed adjust rollers 207 are able to adjust the travel speed of the sheet.

Referring to FIG. 4, in a preferred embodiment, the distance between the speed adjust rollers 207 and the finisher entrance rollers 211 should be about 7–8 inches. This distance is optimal because this distance ensures that the lead edge of the sheets arrives at the finisher entrance rollers 211 before a trial edge of the at least one sheet of sheets 1–9 leaves the speed adjust rollers 207. When the lead edge of the sheet extends out about an inch from the finisher entrance exit nip rollers 211, then the trail edge of the sheet should leave the speed adjust rollers 207 and the sheet arrives at the appropriate time for the finisher entrance roller 211 to accept them. If the speed of the finisher entrance rollers 211 is not constant and predictable, then the speed adjust rollers 207 must release control of the insert sheet or bypass sheet to the finisher entrance rollers 211. This release must occur prior to the finisher entrance rollers 211 changing the speed from the desired entrance speed of 38 ips in this embodiment. This can be accomplished in a variety of method similar to those employed for rollers 213 and 215.

At 329, the at least one sheet of the sheets or at least one photograph are moved by ISAU 201 by utilizing speed adjust rollers 207, nip rollers 213 and 215 to move the sheets to any paper feeder, such as paper feeder 167*b*. When the process is completed the nip rollers 213 and 215, at 329, transfers the sheets to the finisher entrance rollers 211, which in turn transfers the sheets to the finisher device 107 for binding, stapling etc and the process ends at 331. Therefore, all the sheets are combined and are delivered to the finisher device 107 at the correct timing.

In another embodiment, that provides even further latitude, the method wherein the speed adjust rollers are controlled to higher of lower speeds than the input or output speeds is combined with the method wherein the speed adjust rollers are stopped for a period of time. In this embodiment, early sheets would be stopped, normal sheets would transition directly from the input speed to the desired speed, and late sheets would be accelerated to a high speed and then decelerated to the desired speed.

Figure 6:
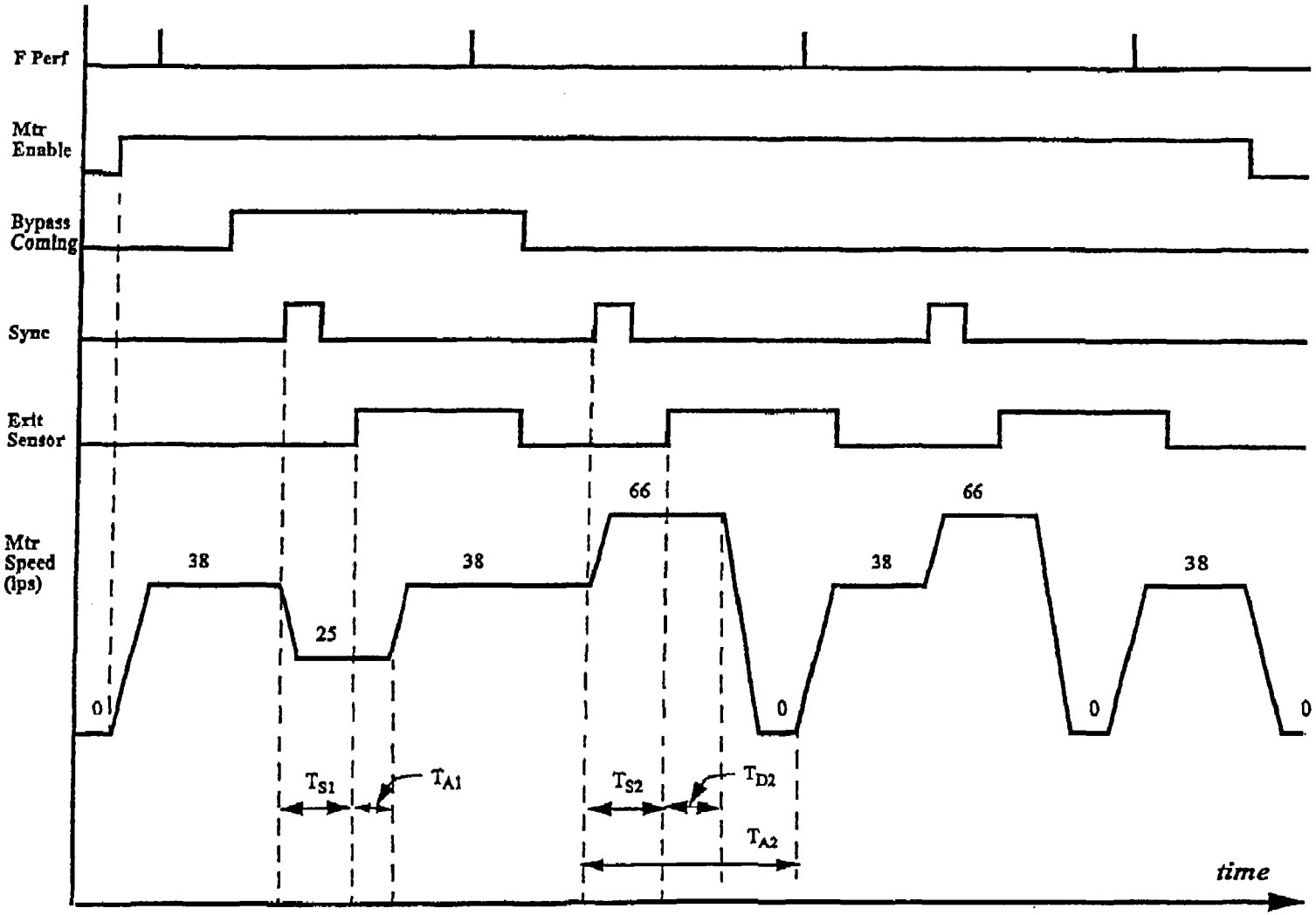
FIG. 6 is a timing diagram of the inserter speed adjust unit of FIG. 3.

FIG. 6 is a timing diagram of the inserter speed adjust unit of FIG. 3. As stated above, as the photoconductor 145 travels around the rollers 147 F-PERF signals are generated and sent to the microprocessor 127*b*. When the first sheet comes from the marking engine 103, the microprocessor 127*b* of ME controller 127 generates the synch pulse signal (sync) at a fixed time relative to the F-PERF signals, when the lead sheet of the first set of sheets approaches ISAU 201. The microprocessor 127*b* also enables the ISAU 201 via the microprocessor 205*b* to enable a signal (Mtr Enable) for the stepper motor 206, which causes the ISAU 201 to energize the stepper motor 206 and wait for the first sync pulse signal for at least one sheet from the first set of sheets. When the stepper motor 206 is enabled, the stepper motor 206 speed increases from 0 ips to 38 ips. When the at least one sheet from a first set of sheets approaches the ISAU 201, the synch pulse signal is generated and the stepper motor 206 speed decreases to 25 ips, which is the speed the sheet is traveling at from marking engine 103. Next, the ISAU 201 waits until the sheets contacts or actuates the ISAU sensor 209. When the sheets contacts the ISAU sensor 209 or exit sensor, then the microprocessor 205*b* measures the time between the sync pulse signal and the arrival time of the signal from the ISAU sensors 209 or the sensor actuation (Ts1). Ts1 may be 120 milliseconds. Microprocessor 205*b* varies the time before acceleration (Ta1) based on Ts1. For example, if the sheet contacts the ISAU sensor 209 late, then Ts1 will be larger than desired and Ta1 will be small. The sheets are then accelerated from 25 ips to 38 ips.

When the second set of sheets come from the inserter 105, the microprocessor 127*b* of ME controller 127 generates the synch pulse signal at a fixed time relative to the F-PERF signals, when a first sheet of the second set of sheets approaches ISAU 201. The microprocessor 127*b* also enables the ISAU 201 via the microprocessor 205*b* to enable a signal (Mtr Enable) for the stepper motor 206. Microprocessor 127*b* causes the ISAU 201 to energize the stepper motor 206 and wait for the first sync pulse signal for at least one sheet of the second set of sheets. When the stepper motor 206 is enabled, the stepper motor 206 speed increases from 38 ips to 66 ips. Next, the ISAU 201 waits until the sheet contacts or actuates the ISAU sensor 209 or exit sensor. When the sheet contacts the ISAU sensor 209, then the microprocessor 205*b* commands the stepper motor 206 to follow a fixed velocity profile to stop the sheets at the desire location. Subsequent to stopping the sheet at the desired location, at a fixed velocity profile after the synch pulse the stepper motor 206 is accelerated to 38 ips to deliver the sheet to the finisher entrance rollers 211 at the appropriate time. Ts2 may be 85 milliseconds. Ta2 represents the total time it will take from the synch pulse until the sheet starts accelerating to the finisher entrance speed of 38 ips. The speed of the speed adjust rollers 207 will be adjusted to 38 ips. Therefore, the travel speed and the timing of the first and second set of sheets will be adjusted so that the sheets will arrive at the finisher entrance rollers 211 at the speed and time of the regular period.

There may be variations in the distance between the insert supplies 167*a*, 167*b* and 167*c* and the ISAU sensor 209. Similarly, there may be variation in the speed of the inserter 105. These variations affect the optimal time between the synch pulse and the desired delivery of the sheet to the ISAU sensor 209. This can be accomplished through a special software program that is used to adjust the feed timing for the feed sources. In this case, the ISAU 201 will be enabled and compensate for sheet timing as it does in normal operation. When a number of sheets are fed from any one of the inserter supplies 167*a*, 167*b* 167*c*, then the average arrival time at ISAU sensor 209 is measured. Once the average arrival time is determined, then the timing of the feed timing sent by the inserter control board 203 can be changed so the sheets nominally arrive at the ISAU sensor 209. If the speed of the inserter 105 were to vary over time, it could be measured and compensated for by modifying the timing for the feed time. In a preferred embodiment, this change is compensated for by the following method. First, the change in sheet timing relative to inserter speed is characterized. Next, a compensation algorithm is approximated by a linear relationship between the inserter speed and the feed timing. The machine speed is calculated from the MTB signal at the start of each run and compared to the machine speed when the feed timing adjustment program was invoked. Thus, the feed timing is modified when there is a variation in the speed of the inserter 105 and variations in the distance between the inserter supplies 167*a*, 167*b* and 167 and the ISAU sensor 209.

The inserter speed adjust unit of the present invention thus provides several advantages over conventional systems. This unit enables the inserter to feed the sheets at speeds higher than downstream devices can accept. This allows more time for sheet acquisition by the vacuum feed heads of the inserter. The system also minimizes sheet to sheet timing variability for sheets delivered to downstream devices.

It is therefore intended that the foregoing detailed description be regarded as illustrative rather than limiting, and that it be understood that it is the following claims, including all equivalents, that are intended to define the spirit and scope of this invention.

The invention claimed is:

1. An image-forming production system, the system comprising;

a marking engine that prints an image onto at least one sheet defining at least one printed sheet, the marking engine having an output which feeds the at least one printed sheet at a first speed;

an inserter connected to receive the at least one printed sheet from the marking engine output, the inserter having an inserter supply that feeds an insert sheet to be placed sequentially with the printed sheet in a print job, the insert supply feeding the insert sheet to the inserter at a second speed; and an inserter speed adjust unit that sequentially receives the at least one printed sheet at the first speed and the insert sheet at the second speed and outputs both at an adjusted third speed wherein:

the marking engine transmits a synch pulse signal used to indicate a nominal time when the at least one printed sheet is to arrive at the inserter speed adjust unit;

the inserter speed adjust unit determines the actual arrival time of the at least one printed sheet at the inserter speed adjust unit; and the inserter speed adjust unit compares the synch pulse signal to the actual arrival time and uses the comparison to determine an adjust time when the inserter speed adjust unit changes the speed of the at least one sheet from the first speed to the third speed.

2. The image-forming production system of claim 1, wherein the inserter speed adjust unit adjusts the timing at which the at least one printed sheet and the insert sheet are output from the inserter speed adjust unit to refine the timing at which the at least one printed sheet and the insert sheet are outputted at the third speed.

3. The image-forming production system of claim 1 further comprising an output device connected downstream of the inserter, the output device having an output device input speed at which it receives sheets to be processed, wherein the output device input speed corresponds to the third speed.

4. The image-forming production system of claim 1 wherein the inserter speed adjust unit accelerates the at least one printed sheet from the first speed to a higher third speed and (1) if the at least one printed sheet arrives earlier than the nominal time, the inserter speed adjust unit changes from the first speed to the third speed later than the adjust time and (2) if the sheet arrives later than the nominal time, the inserter speed adjust unit changes from the first speed to the third speed earlier than the speed adjust time.

5. The image-forming production system of claim 1 wherein the inserter speed adjust unit changes the speed of the at least one printed sheet to a fourth speed different from the first and third speeds before the speed is changed to the third speed.

6. The image-forming production system of claim 1 wherein the inserter speed adjust unit first stops the at least one printed sheet after it is received and before the inserter speed adjust unit adjusts the speed to the third speed.

7. The image-forming production system, the system comprising;

a marking engine configured to output a plurality of printed sheets at a first speed, the marking engine including a marking engine controller; the marking engine controller transmitting a synch pulse signal after a predetermined period of time;

an inserter connected to receive the plurality of printed sheets from the marking engine and output an insert sheet at a second speed to be inserted between two of the plurality of printed sheets; and an inserter speed adjust unit connected to receive the plurality of printed sheets at the first speed and the insert sheet at the second speed, the inserter speed adjust unit transmitting a signal to the inserter speed adjust unit controller of an arrival of one of the printed sheets and the arrival of the insert sheet the insert speed adjust unit including an inserter speed adjust unit controller;

the inserter speed adjust unit controller being configured to compare the measured arrival time with the synch pulse signal to determine an adjust time at which to adjust a speed of the plurality of printed sheets from the first speed to a third speed and to adjust the speed of the insert sheet from the second speed to the third speed and output the plurality of sheets and the insert sheet at the third speed.

8. The image-forming production system of claim 7 wherein the inserter speed adjust unit comprises speed adjust rollers and an inserter speed adjust unit sensor.

9. The image-forming production system of claim 7 further comprising an output device connected downstream of the inserter, the output device having an output device input speed at which it receives sheets to be processed, wherein the output device input speed corresponds to the third speed.

10. The image-forming production system of claim 7 wherein the inserter speed adjust unit accelerates the at least one printed sheet from the first speed to the third speed and (1) if the at least one printed sheet arrives earlier than the nominal time, the inserter speed adjust unit changes from the first speed to the third speed later than the adjust time and (2) if the sheet arrives later than the nominal time, the inserter speed adjust unit changes from the first speed to the third speed earlier than the speed adjust time.

11. The image-forming production system of claim 7 wherein the inserter speed adjust unit changes the speed of the at least one printed sheet to a fourth speed different from the first and third speeds before the speed is changed to the third speed.

12. The image-forming production system of claim 7 wherein the inserter speed adjust unit first stops the at least one printed sheet after it is received and before the inserter speed adjust unit adjusts the speed to the third speed.

13. The image-forming production system of claim 7 wherein the inserter sheet stops at a fixed position for a period of time the insert sheet is fed from the position at a fixed time after the synch pulse signal.

14. A method of outputting sheets image-forming production system having a post marking engine inserter, the method comprising;

in a marking engine, printing an image onto at least one sheet defining at least one printed sheet, and outputting at least one printed sheet at a first speed from the marking engine;

feeding an insert sheet to be placed sequentially with the printed sheet in a print job at a second speed; and sequentially receiving the at least one printed sheet at the first speed and the insert sheet at the second speed and changing the speed of both to a third speed and adjusting the timing at which the at least one printed sheet and the insert sheet are output; wherein the speed of the at least one printed sheet and the insert sheet are adjusted at an inserter speed adjust unit;

transmitting a synch pulse signal indicating a nominal time when the at least one printed sheet is to arrive at the inserter speed adjust unit;

determining the time from the synch pulse signal to an actual arrival time of the at least one printed sheet at the inserter speed adjust unit;

determining a time difference to the nominal time between the synch pulse signal and the actual arrival time to determine an adjust time when the inserter speed adjust unit changes the speed of the at least one sheet from the first speed to the third speed;

adjusting the speed of the at least one sheet from the first speed to the third speed;

transmitting a synch signal indicating a nominal time when the insert sheet is to arrive at the inserter speed adjust unit;

determining the time from the synch pulse signal to an actual arrival time of the insert sheet at the inserter speed adjust unit;

determining a time difference to the nominal time between the synch pulse signal and the actual arrival time to determine an adjust time when the inserter speed adjust unit changes the speed of the insert sheet from the first speed to the third speed; and adjusting the speed of the insert sheet from the first speed to the third speed.

15. The method of claim 14 comprising accelerating the at least one printed sheet from the first speed to the third speed and (1) if the at least one printed sheet arrives earlier than the nominal time, changing from the first speed to the third speed later than the adjust time and (2) if the sheet arrives later than the nominal time, from the first speed to the third speed earlier than the speed adjust time.

16. The method of claim 14 further comprising changing the speed of the at least one printed sheet to a fourth speed different from the first and third speeds before the speed is changed to the third speed.

17. The method of claim 14 further comprising stopping the at least one printed sheet or inserter sheet after it is received in the inserter speed adjust unit and before the speed is changed to the third speed.

* * * * *